US006694679B2

(12) United States Patent
Verna

(10) Patent No.: US 6,694,679 B2
(45) Date of Patent: Feb. 24, 2004

(54) SAFETY STAND

(76) Inventor: Giuliano Verna, 543 Wigard Ave., Philadelphia, PA (US) 19128

( * ) Notice: Subject to any disclaimer, the term of this patent is extended or adjusted under 35 U.S.C. 154(b) by 0 days.

(21) Appl. No.: 09/981,030

(22) Filed: Oct. 17, 2001

(65) Prior Publication Data

US 2002/0046507 A1 Apr. 25, 2002

(51) Int. Cl.[7] ..... E04G 21/14

(52) U.S. Cl. ..... 52/79.2; 52/749.1; 52/127.2; 248/351

(58) Field of Search ..... 248/351, 346.01, 248/357; 52/79.2, 749.1, DIG. 1, 127.2; 414/11; 182/230, 129

(56) References Cited

U.S. PATENT DOCUMENTS

| | | | | | |
|---|---|---|---|---|---|
| 1,259,049 | A | | 3/1918 | Schumacher | |
| 1,585,937 | A | | 5/1926 | Paul | |
| 2,167,198 | A | | 7/1939 | Brownsteim | |
| 2,466,149 | A | * | 4/1949 | Burg | 280/79.7 |
| 2,514,308 | A | * | 7/1950 | Burg | 280/79.3 |
| 2,681,233 | A | * | 6/1954 | Smith | 280/79.3 |
| 2,967,627 | A | * | 1/1961 | Vinson | 254/2 R |
| 4,009,891 | A | * | 3/1977 | Jensen | 280/651 |
| 4,023,686 | A | * | 5/1977 | Papsco et al. | 414/11 |
| 4,241,930 | A | * | 12/1980 | Bell et al. | 280/47.29 |
| 4,488,733 | A | | 12/1984 | Hellsten | |
| 5,584,399 | A | | 12/1996 | King | |
| 5,584,635 | A | * | 12/1996 | Stapelmann | 414/11 |
| 6,241,447 | B1 | * | 6/2001 | Echternacht | 414/11 |

* cited by examiner

*Primary Examiner*—Carl D. Friedman
*Assistant Examiner*—Basil Katcheves
(74) *Attorney, Agent, or Firm*—Stephen H. Eland; Dann, Dorfman, Herrell and Skillman

(57) ABSTRACT

A safety stand for safely holding a heavy slab of material is provided. The stand is configured so that a heavy slab can be safely leaned against it. Once the slab is leaned against the stand, the top edge of the slab is in a position such that a lifting clamp or similar device can be attached to the slab. With the stand in place, one person can safely prepare the slab for lifting.

8 Claims, 3 Drawing Sheets

SAFETY STAND

FIELD OF THE INVENTION

The present invention relates to frames, racks or stands, and more specifically to stands used to safely support large and heavy materials, including slabs, frames or trusses containing marble, granite, glass, sheet metal or wood.

BACKGROUND OF THE INVENTION

The handling of large heavy slabs of material, such as marble or granite, can be labor intensive and dangerous. An individual slab of marble may weigh as much as 1,200 pounds. To move an individual slab, the handler attaches a lifting clamp or similar device to the top edge of the slab. The clamp may be connected to a crane, an overhead winch, a fork lift or other lifting means. Once the clamp is attached to the slab, the slab can be lifted from its position and moved to a desired location.

Attachment of the clamp to the top edge of the slab is often difficult. Many times, the slab is leaned up against a wall or object, with the top edge of the slab resting flush against the adjacent wall or object. To place the clamp around the top edge, the slab must be tilted away from the wall or object to create adequate clearance for the clamp.

In many cases, the handlers tilt the slab by hand, insert a spacing block between the slab and the adjacent surface, and then lean the slab back against the spacing block to establish a clearance between the top edge of the slab and the adjacent wall or object. This method requires at least two laborers to complete, due to the weight of the slab. In addition, the method is very cumbersome. Some slabs have a height of over six feet, making it difficult to tilt the slab and place the spacing block behind the slab. Once the spacing block is placed, the block can fall down between the slab and the adjacent wall or object, allowing the top edge to fall back against the wall or object. Moreover, there may be insufficient space for two laborers to work around the slab. For instance, slabs may be delivered on a fully loaded flat bed truck. In such cases, laborers must stand on narrow ledges on the truck bed to maneuver the slabs and prepare them for lifting.

Aside from its difficulties, the method described above is very dangerous. The handler who holds the slab in a tilted position can lose grip on the slab or be overcome by the slab's weight if the slab is tilted too much. The handler who reaches behind the slab to place the spacing block risks crushing a finger or an arm if the slab falls back against the adjacent wall or object. As a result, this method has many problems regarding implementation and worker safety.

SUMMARY OF THE INVENTION

With the foregoing in mind, the present invention provides an apparatus for safely holding a heavy slab. In particular, the present invention holds a slab away from adjacent walls or objects to allow a lifting clamp to be attached to the top edge of the slab. The apparatus includes a light-weight free-standing frame or stand that safely holds a slab in a tilted position to allow a handler to attach a lifting clamp to the slab. Since the stand safely holds the slab, one person can tilt the slab and attach the lifting clamp to the slab without any assistance. The stand is compact so that it can easily be lifted and used in areas where space is limited, such as the edge of a flat bed truck. The present invention also includes a method for safely placing a slab in a tilted position on a stand to allow attachment of a lifting clamp to the slab.

The apparatus preferably includes a base member attached to the midpoint of a cross member, forming a T shape. A front support member extends generally vertically from the midpoint of the cross member. The front support member is braced by a rear support member that extends from the rear end of the base member up to a point along the mid span of the front support member. A toe plate is connected to the front of the cross member and extends forwardly from the apparatus to be inserted beneath a slab. The toe plate and front support member are pitched so as to allow the slab to be leaned against the stand at a small angle. In this position, the slab's force on the stand is significantly small relative to the weight of the slab.

DESCRIPTION OF THE DRAWINGS

All of the objects of the present invention are more fully set forth hereinafter with reference to the accompanying drawings, wherein.

DESCRIPTION OF THE PREFERRED EMBODIMENT

Figure 1:
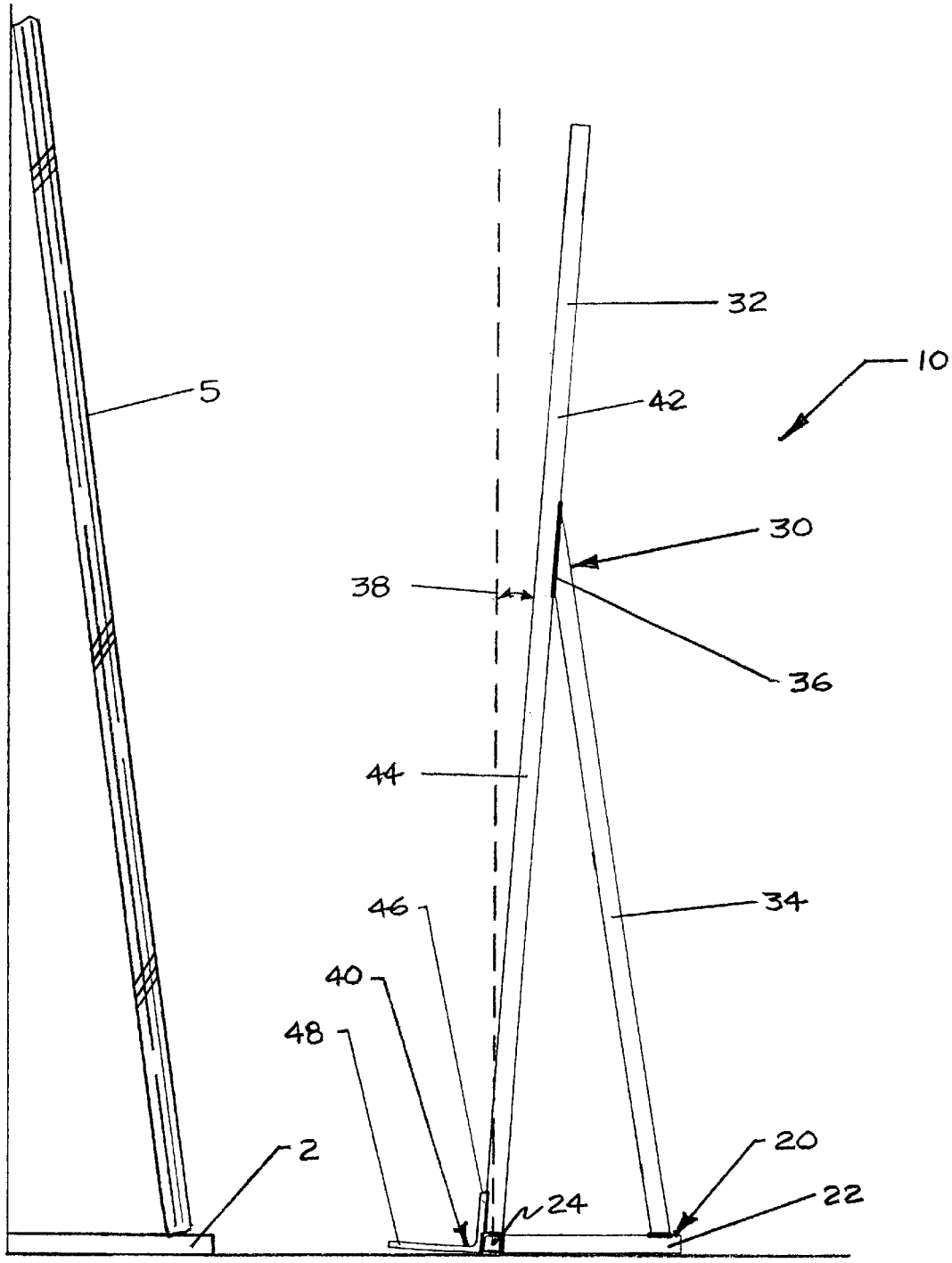
FIG. 1 is an elevation view of the preferred embodiment prepared for use.
Figure 2:
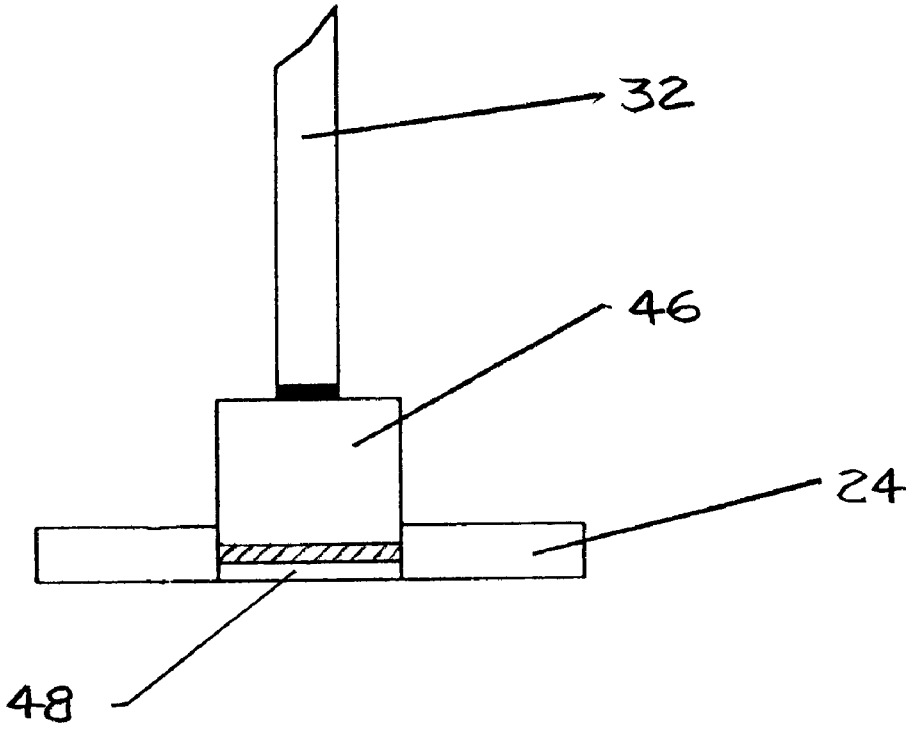
FIG. 2 is a frontal view of the device in FIG. 1.
Figure 3:
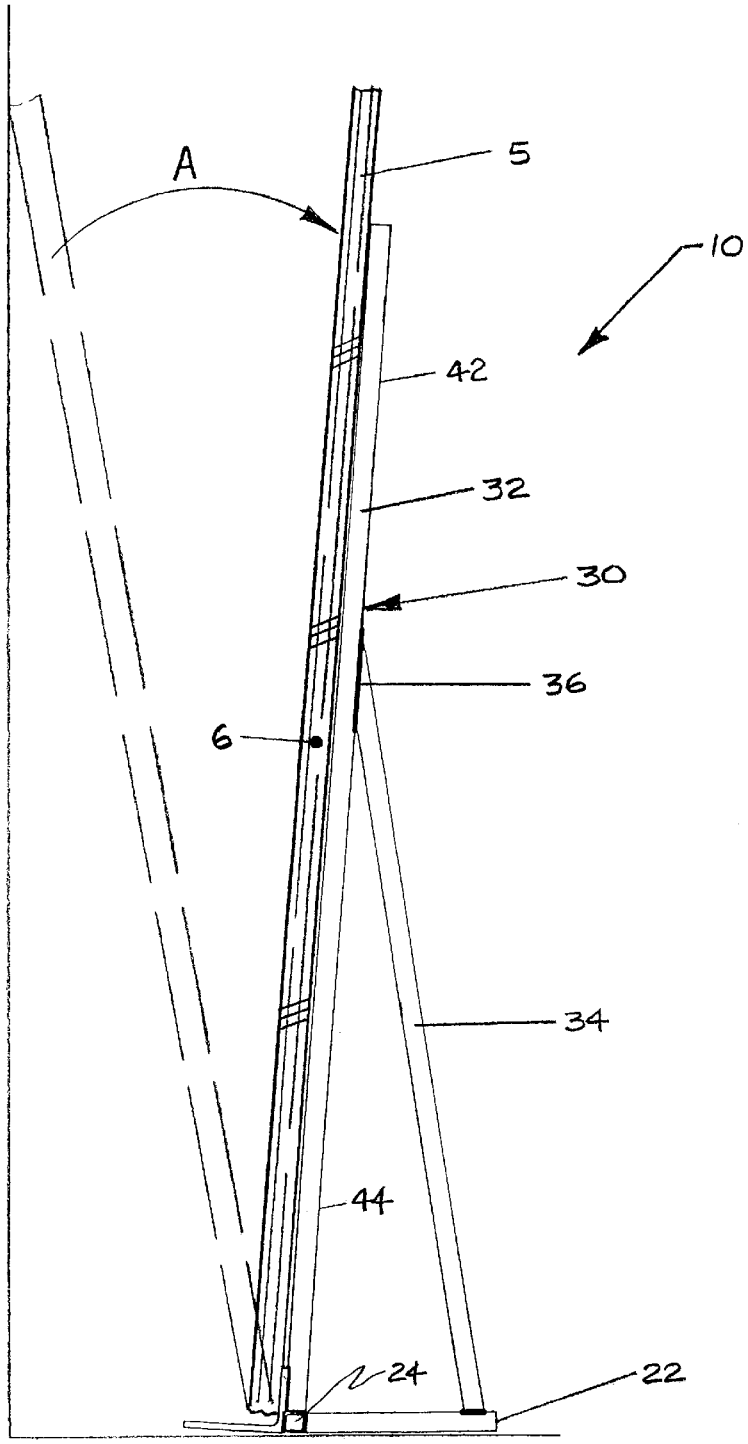
FIG. 3 is an elevation view of the device in FIG. 1 illustrating the operation of the device.

Referring now to FIGS. 1–3 in general and to FIG. 1 specifically, there is shown a stone stand 10 having a base 20 and a support frame 30 that extends generally vertically from the base to form a rigid stand. The stand 10 is compact and light-weight so that it can be easily lifted and maneuvered. A toe plate 40 extends forwardly from the base 20 and is configured to be inserted beneath a slab of material 5. Prior to being lifted, the slab 5 is positioned so that the bottom edge of the slab is raised above the floor. In FIG. 1, the slab is raised off the floor using wooden shims 2.

The stand 10 is compact, which allows the stand to be used in areas where space is limited. For instance, when slabs are off-loaded from flat bed trucks, the slabs take up much of the truck bed, so that workers must stand on narrow ledges to maneuver the slabs. The stone stand 10 is compact enough to be used safely on narrow ledges. The base 20 is formed by two members, which take up very little floor space.

Referring to FIGS. 1–2, the construction of the base 20 is shown. The base 20 is formed by a base member 22 attached to a cross member 24. Preferably, the base member 22 is attached to an edge of the cross member 24 such that the end of the base member is connected at the midpoint of the cross member. Preferably, the length of the base member 22 is eighteen inches or shorter, so that the stand 10 may be used on narrow ledges or other areas having limited floor space.

Referring again to FIG. 1, the support frame 30 includes an elongated vertical front support member 32 and a rear support member 34 connected to the rear edge of the front support member. The front support member 32 extends generally vertically from the midpoint of the top edge of the cross member 24. The front support member 32 forms an acute angle 38 relative to a vertical axis extending from the lower end of the front support member, as shown by the dashed line in FIG. 1. Preferably, the angle 38 is between 5 and 10 degrees.

The rear support member 34 extends upwardly from the base 20 and is connected to the front support member 32 to act as a brace for the front support member. More specifically, the rearward end of rear support member 34 is mitered to rest flush against the top edge of the base member 22 near the rearward end of the base member. The rear support member 34 extends upwardly and forwardly from the rearward end of the base member 22. The forward end of rear support member 34 is mitered to adjoin the rearward edge of front support member 32 and form a brace joint 36. The brace joint 36 divides the front support member 32 into an upper span 42 and a lower span 44.

The toe plate 40 extends from the midpoint of the front edge of the cross member 24, as illustrated in FIG. 1. The toe plate 40 is an L-shaped member that includes a bottom plate 46 and a back plate 48 generally perpendicular to the bottom plate. Preferably, the front edge of the front support member 32 is flush with the front edge of cross member 24 to form an even surface for mounting the toe plate 40. The toe plate 40 is connected to the front support member 32 and cross member 24 to form a continuous bottom edge with the bottom edge of the base 20. More specifically, the toe plate 40 is mounted so that the bottom edge of the bottom plate 46 is generally flush with the bottom edges of the cross member 24 and base member 22 to provide stability and minimize rocking of the stand 10. The back plate 48 generally conforms to the small tilt angle 38 of the front support member 32, such that the bottom plate 46 is pitched slightly upwardly as it extends away from the front support member. This incline assists in urging the slab 5 toward a leaning position on the stand 10.

Referring now to FIG. 3, the slab 5 is shown leaning against the stand 10. For clarity, the shims 2 are omitted from FIG. 3. When the slab 5 is leaned against the stand 10, the top edge of the slab 5 preferably extends above the front support member 32. In this way, the top of the front support member 32 does not obstruct the top edge of the slab 5 and interfere with the attachment of the lifting clamp. The front support member 32 is configured to receive the slab 5 in a leaning position with the face of the slab flush against the front support member 32. The slab leans at an angle conforming with the tilt angle 38 of the front support member. In this position, the slab has a center of gravity 6 located at a vertical distance above the base 20.

The slab 5 exerts a force against the support frame 30 in response to gravity. The force is generally distributed uniformly along the length of the front support member 32. The tilt angle 38 of the front support member 32, which generally defines the angle of the slab 5 when the slab is placed on the stand, is very small, preferably ranging between 5 and 10 degrees. Since the slab 5 leans at a small angle on the stand 10, substantially all of the slab's weight is distributed downwardly, and only a small fraction of the slab's weight bears against the support frame 30.

When the slab 5 is leaned against the stand 10, the force that bears against the front support member 32 creates a moment about the midpoint of cross member 24. This moment urges the front support member 32 to rotate or bend rearwardly. To counterbalance the slab's force on the front support member 32, the brace joint 36 is preferably positioned so that the joint is higher than the center of gravity of the slab 5. Moreover, the axial length of the upper span 42 is preferably less than the axial length of the lower span 44. This gives the support frame 30 stability and limits deflection of the front support member 32 when the slab 5 is leaned on the stand 10.

The brace joint 36 is also positioned to provide rigidity in the lower span 44. When shorter slabs are leaned against the stand 10, there is a potential for buckling or bending in the lower span 44. This is especially true if the height of the slab is shorter than the length of the lower span 44. In such a case, the slab's force on the front support member 32 will be absorbed entirely by the lower span 44. As the ratio of the lower span's length to the thickness of the front support member 32 increases, the potential for buckling in the lower span increases. Therefore, preferably the brace joint 36 is located near the midpoint of the front support member 32 to limit the length of the lower span 44. More specifically, preferably, the distance between the brace joint 36 and midpoint of the front support member 32 is substantially smaller than the distance between the brace joint and upper end of the front support member.

The base member 22, cross member 24, front support member 32 and rear support member 34 are constructed out of strong light-weight materials, such as corrosion-resistant square steel tubing. Preferably, the ends of the steel tubing contain caps to seal off the interior of the tubing and prevent moisture from entering the tubing. The toe plate 40 is formed of a strong material, such as a three eighth inch steel plate or bracket, capable of supporting a slab without deflection. The aforementioned components can be connected using a variety of conventional joining methods, including welding or bolts.

Referring now to FIG. 3, the operation of the stand 10 will be described. The slab 5 to be lifted is initially tilted on its side and placed on shims, beams or the like so that the bottom edge of the slab is raised above the floor. The stand 10 is then inserted beneath the slab 5 and centered so that the toe plate 40 is generally adjacent to the midpoint of the slab's bottom edge. Where the clearance between the slab 5 and floor is small, the stand 10 may be tilted forward as necessary so that the inclined bottom plate 46 can be inserted beneath the slab. The stand 10 is positioned so that the cross member 24 is generally parallel to the front face orientation of the slab 5.

Once the toe plate 40 is beneath the slab 5, the stand 10 is maneuvered under the slab until that the back plate 48 of toe plate 40 abuts the face of the slab, as shown in FIG. 3. Preferably, the vertical clearance between the bottom plate 46 and the slab is no more than one half inch. However, it is not crucial that the bottom edge of the slab 5 contact the bottom plate 46, since the shims will continue to support the slab. Once the stand 10 is in place, the slab 5 is slowly tilted in the direction marked A in FIG. 3. The slab is then leaned on the front support member 32 so that a lifting clamp can be attached to the top edge of the slab. The lifting clamp is then raised vertically to lift the slab.

The terms and expressions which have been employed are used as terms of description and not of limitation. There is no intention in the use of such terms and expressions of excluding any equivalents of the features shown and described or portions thereof. It is recognized that various modifications are possible within the scope and spirit of the invention. For instance, the device may include a flat steel toe plate fixed to the underside of the base as opposed to the L shaped toe plate 40 described above. This toe plate would provide a uniform planar surface to support the stand and minimize rocking. Accordingly, the invention incorporates variations that fall within the scope of the following claims.

What is claimed is:

1. An apparatus for supporting a slab, comprising:

a. a base member having a forward end and a rearward end;

b a crossmember attached to the forward end of the base member so that the crossmember is disposed in a horizontal plane with the base member;

c. a vertical support member attached to the base member adjacent the forward end, transverse the base member, so that the vertical support member forms an acute angle with a vertical plane normal to the base member;

d. a brace having a first end attached to the base member adjacent the rearward end of the base member, and a second end intersecting the vertical support member at a brace joint, wherein the brace joint divides the vertical support member into an upper span and a lower span; and e. a substantially planar tongue attached to the crossmember and projecting forwardly from the crossmember so that the tongue is operable to engage and support the lower edge of the slab, wherein the rearward end of the base member is engageable with the ground when the tongue is adjacent the ground.

2. The apparatus of claim 1 wherein the acute angle formed between the vertical support member and the vertical plane is within the range of approximately 3–7 degrees so that the tongue supports substantially all of the weight of the slab when the forward and rearward ends of the base member engage the ground.

3. The apparatus of claim 1 wherein the slab has a bottom edge and a the center of gravity vertically spaced from the bottom edge, and the brace joint is positioned so that the lower span terminates above the center of gravity of the slab when the slab is supported by the apparatus.

4. The apparatus of claim 1 wherein the upper span is shorter than the lower span.

5. The apparatus of claim 1 wherein the tongue forms an angle with the horizontal plane in which the base member and crossmember are disposed.

6. The apparatus of claim 1 wherein the second end of the brace is fixedly connected with the vertical support at the brace joint.

7. The apparatus of claim 1 wherein the vertical support is rigidly connected with the crossmember.

8. The apparatus of claim 1 wherein the base and the crossmember form a generally flat bottom surface for directly engaging the ground during use.

* * * * *